US008240776B2

(12) United States Patent
Plumley

(10) Patent No.: US 8,240,776 B2
(45) Date of Patent: Aug. 14, 2012

(54) ARTICULATE CONTINUOUS MINER

(76) Inventor: Roger Dale Plumley, Crab Orchard, WV (US)

( * ) Notice: Subject to any disclaimer, the term of this patent is extended or adjusted under 35 U.S.C. 154(b) by 189 days.

(21) Appl. No.: 12/380,494

(22) Filed: Mar. 2, 2009

(65) Prior Publication Data

US 2010/0219675 A1 Sep. 2, 2010

(51) Int. Cl.
*E21C 25/00* (2006.01)

(52) U.S. Cl. ..... 299/75; 299/66

(58) Field of Classification Search ..... 299/64, 299/66, 75

See application file for complete search history.

(56) References Cited

U.S. PATENT DOCUMENTS

| | | | | | |
|---|---|---|---|---|---|
| 2,115,640 | A | * | 4/1938 | Levin | 198/520 |
| 2,920,879 | A | * | 1/1960 | Driehaus | 299/64 |
| 2,986,385 | A | * | 5/1961 | Densmore | 299/57 |
| 3,000,620 | A | * | 9/1961 | Densmore | 299/64 |
| 3,317,245 | A | * | 5/1967 | Arndt | 299/76 |
| 3,437,382 | A | * | 4/1969 | Meissner et al. | 299/56 |
| 3,516,712 | A | * | 6/1970 | Bennett et al. | 299/64 |
| 3,698,769 | A | * | 10/1972 | Amoroso | 299/73 |
| 4,022,083 | A | * | 5/1977 | Pollak-Banda et al. | 74/665 B |
| 4,113,123 | A | * | 9/1978 | Jeffrey | 414/718 |
| 4,341,424 | A | * | 7/1982 | Wilcox et al. | 299/57 |
| 4,390,211 | A | * | 6/1983 | Thompson | 299/57 |
| 4,746,170 | A | * | 5/1988 | Etherington et al. | 299/75 |
| 4,887,868 | A | * | 12/1989 | Plumley | 299/57 |
| 4,921,309 | A | * | 5/1990 | Harrison | 299/75 |

* cited by examiner

*Primary Examiner* — Sunil Singh

(57) ABSTRACT

A continuous mining machine in which the machine is capable of mining a width exceeding the width of the machine chassis by articulating the cutter end of the machine relative to the rear of the machine.

1 Claim, 18 Drawing Sheets

ARTICULATE CONTINUOUS MINER

BACKGROUND

To mine desired width, most continuous miners must move entire chassis side to side to achieve desired mining width, since the cutter assembly and rear chassis are fixed (other than height adjustment).

To achieve full cutting width desired without repositioning entire chassis, an articulation movement of cutter assembly relative to rear chassis of machine is needed.

SUMMARY OF INVENTION

It is the object of this invention to provide the ability to mine full desired mining width without repositioning the entire machine chassis.

The cutter boom assembly, gathering conveyor assembly, and yoke articulate (left/right) providing an ability to mine desired width while rear of machine is stationary.

Top view—swung condition Illustrated to show while mining

Figure 4A:
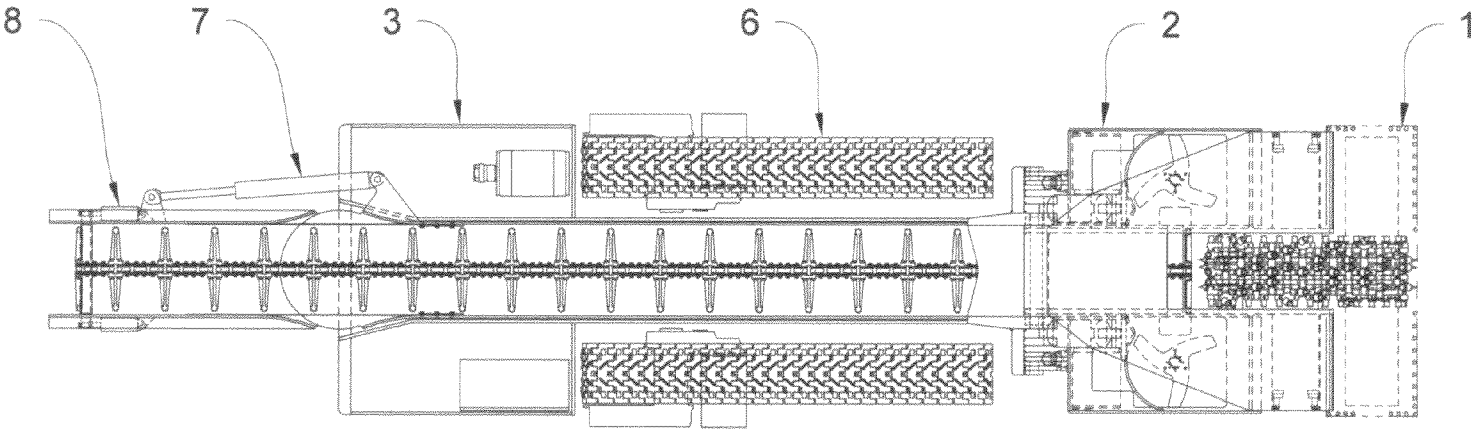

FIG. 4A General Arrangement of present invention

Top View alternate non-articulated version

Figure 4B:
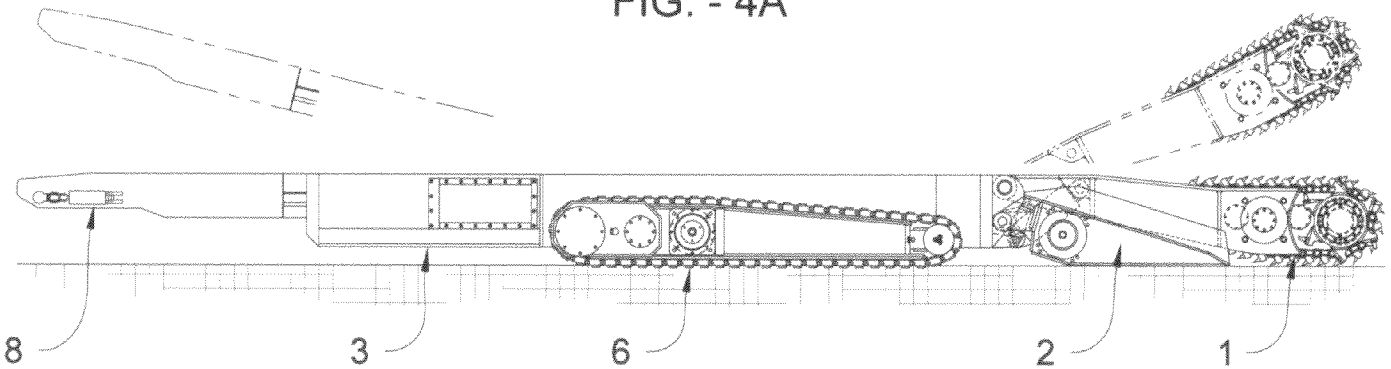

FIG. 4B General Arrangement of present invention

Side View alternate non-articulated version

Figure 5A:
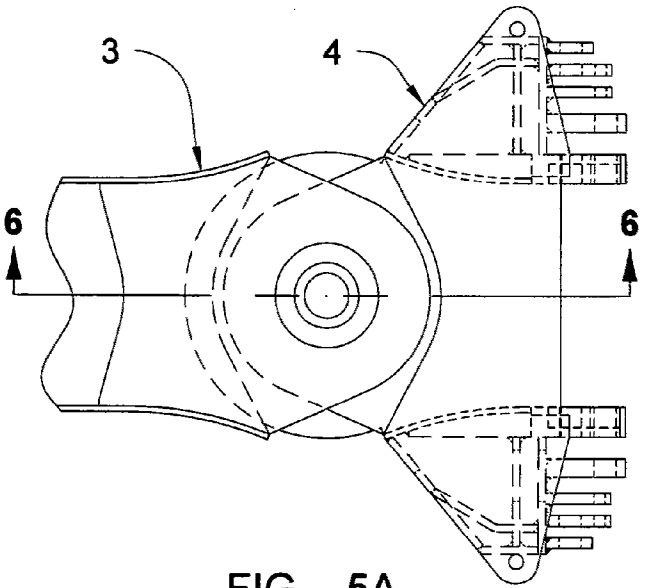

FIG. 5A Articulation joint detail—Top View

Figure 5B:
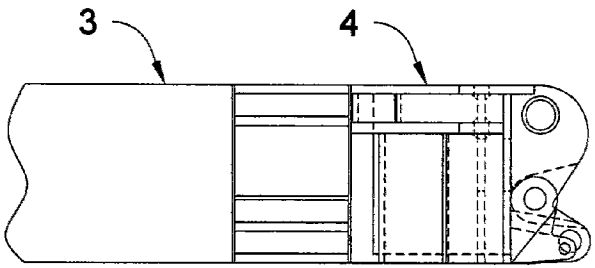

FIG. 5B Articulation joint detail—Side View

Figure 5C:
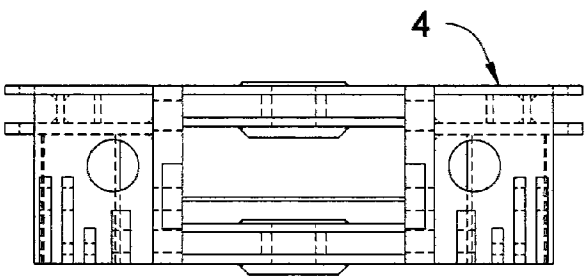

FIG. 5C Articulation joint detail—End View

Figure 6:
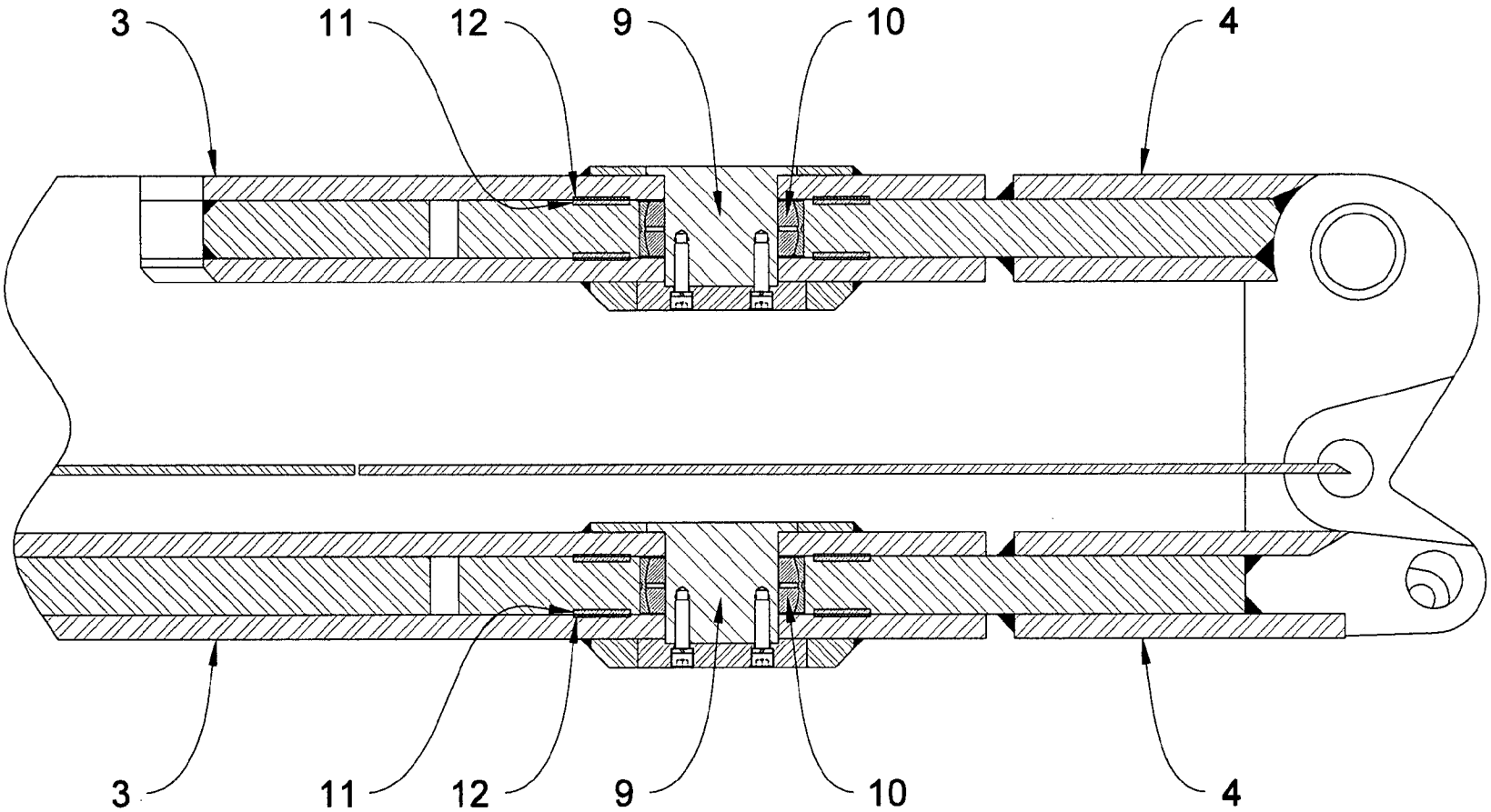

FIG. 6 Section view taken at cutting plane 6-6 (See FIG. 5A)

Figure 7:
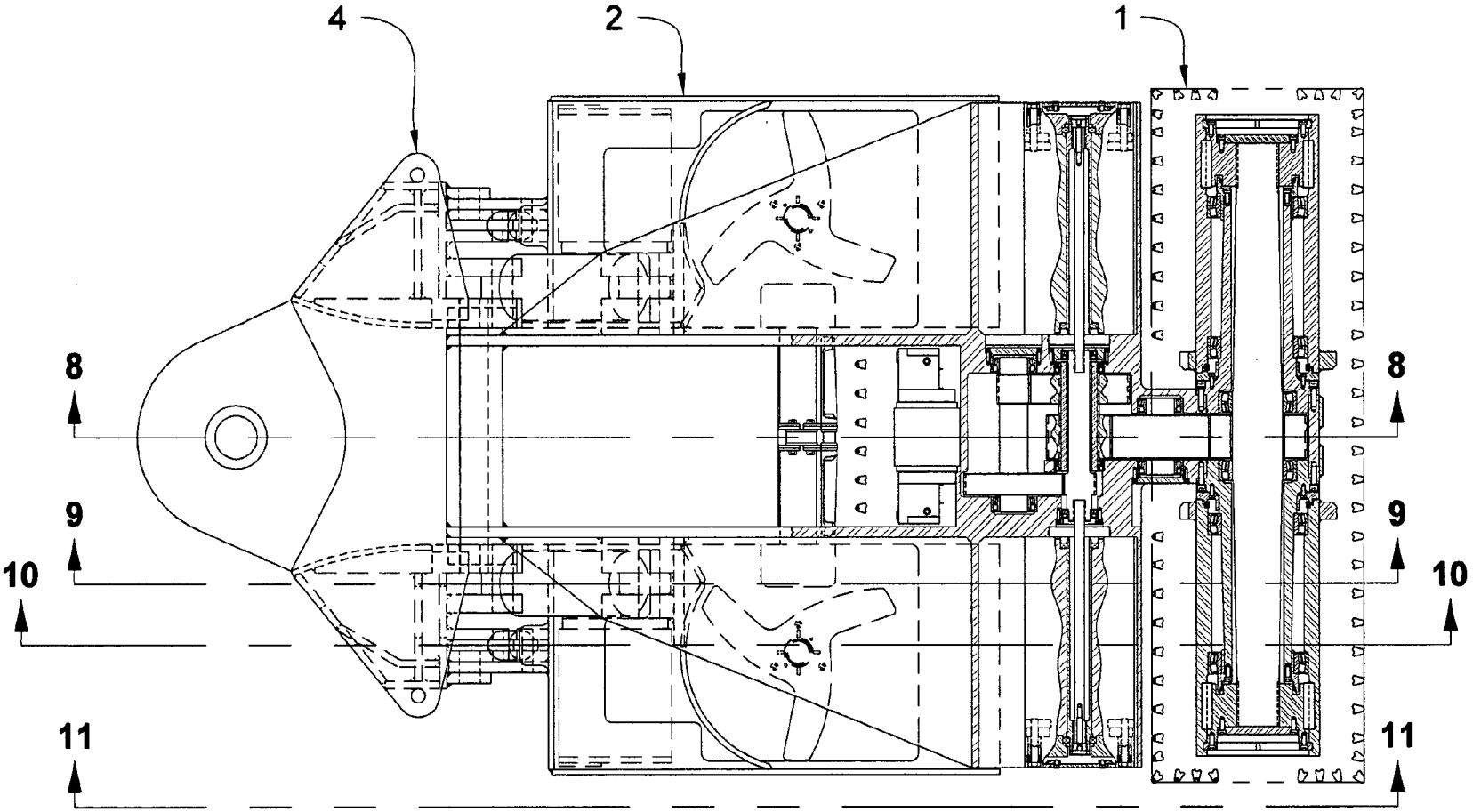

FIG. 7 Detail view of cutter head, gathering conveyor, and yoke

Figure 8:
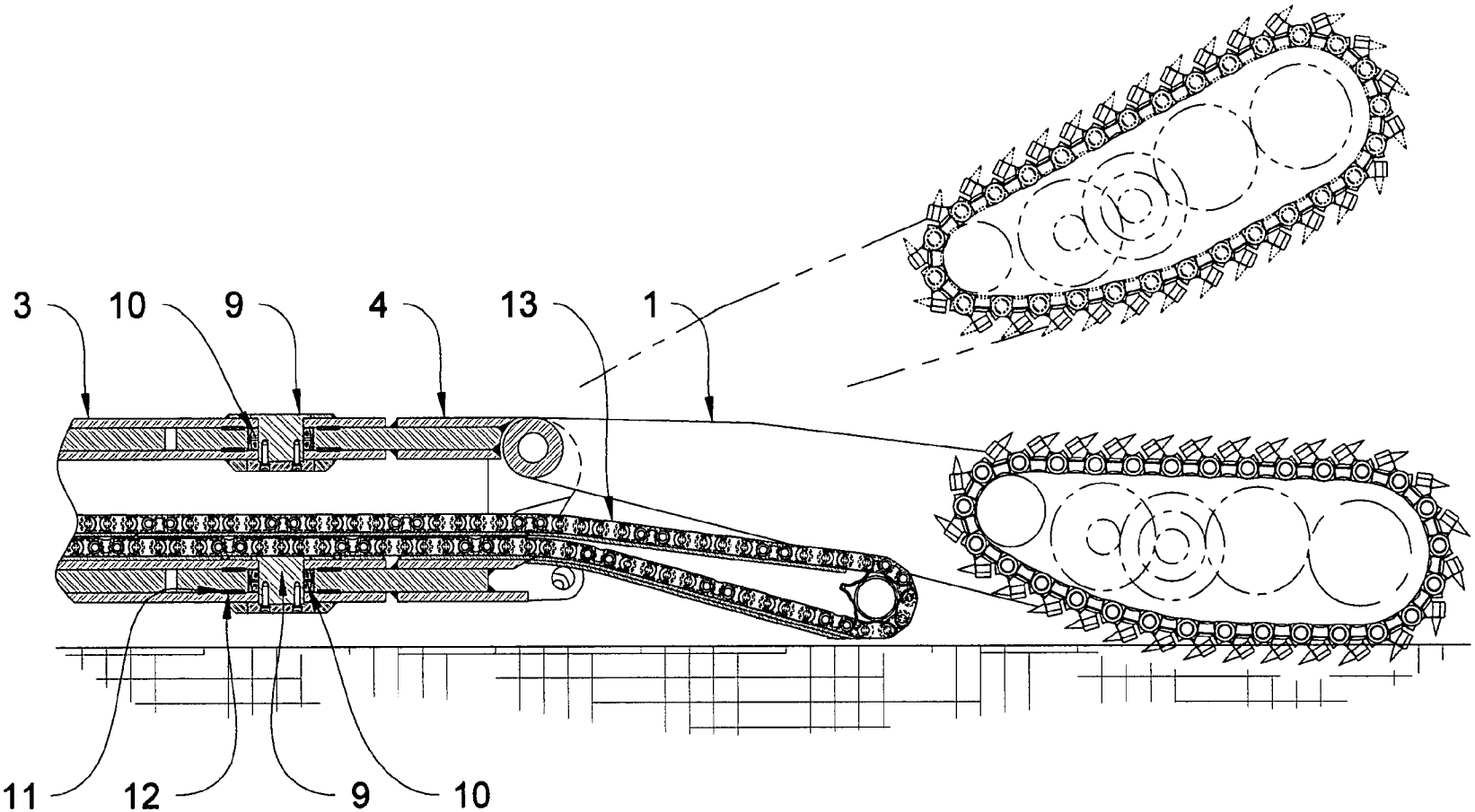

FIG. 8 Section view taken at cutting plane 8-8 (See FIG. 7)

Figure 9:
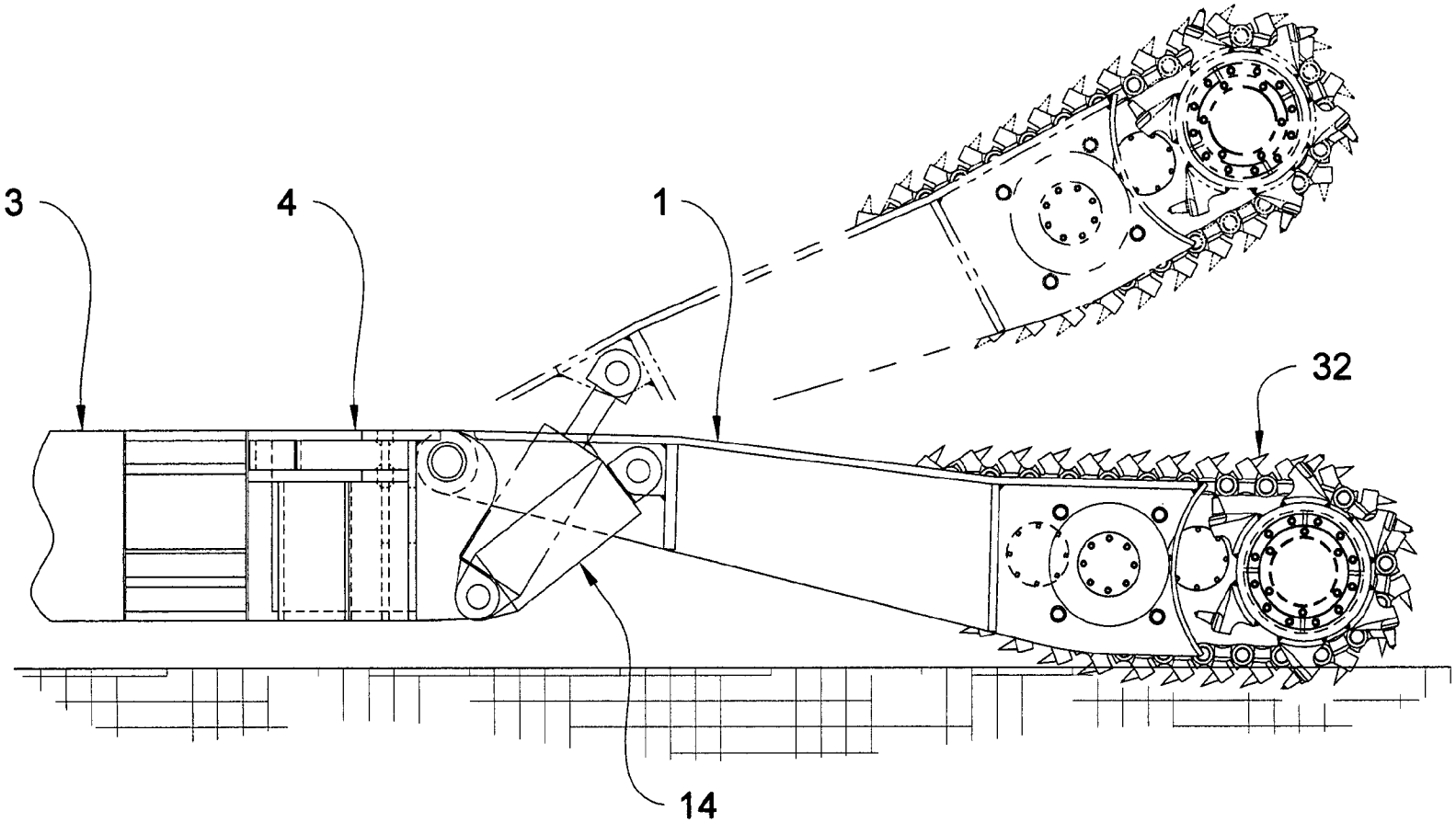

FIG. 9 Section view taken at cutting plane 9-9 (See FIG. 7)

Figure 10:
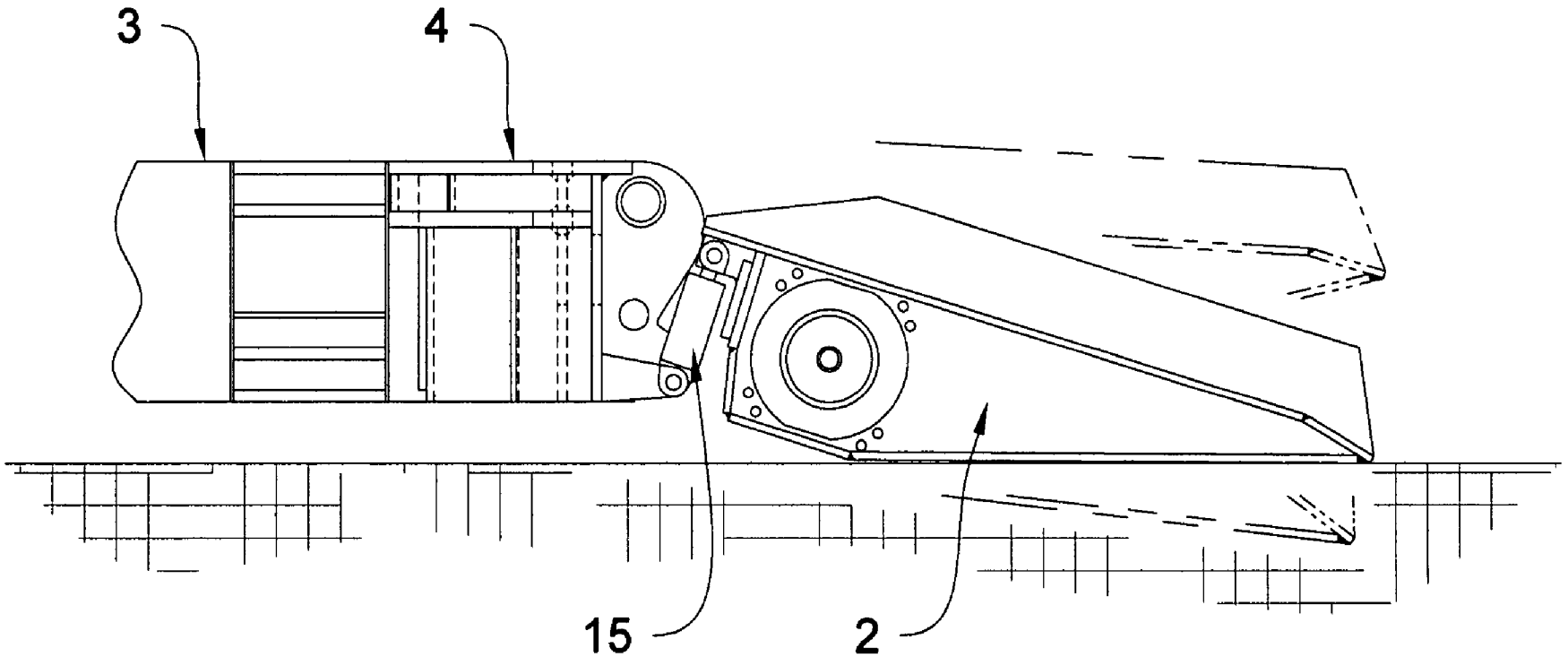

FIG. 10 Section view taken at cutting plane 10-10 (See FIG. 7)

Figure 11:
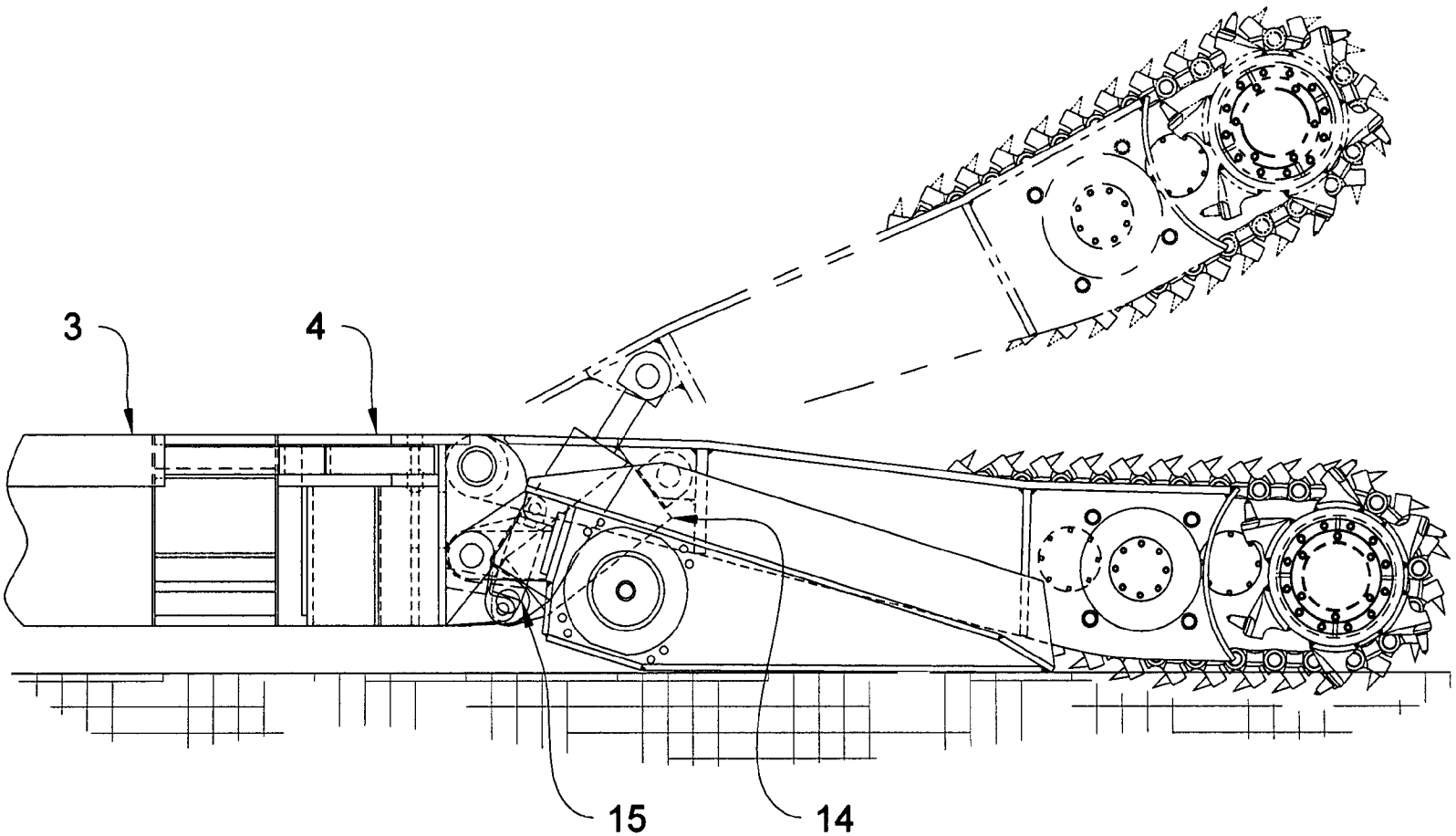

FIG. 11 Section view taken at cutting plane 11-11 (See FIG. 7)

Figure 12:
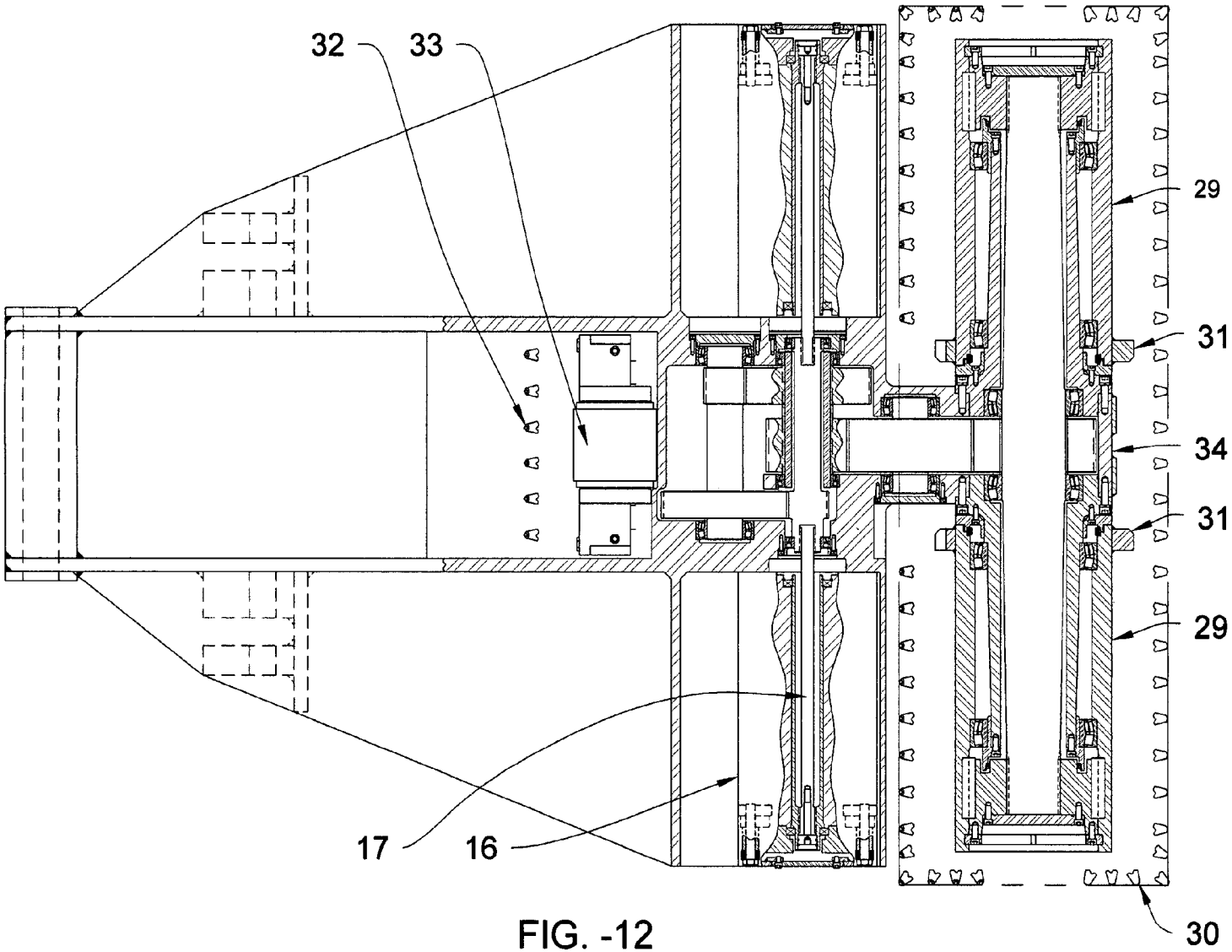

FIG. 12 Detail of cutter boom assembly

Figure 13:
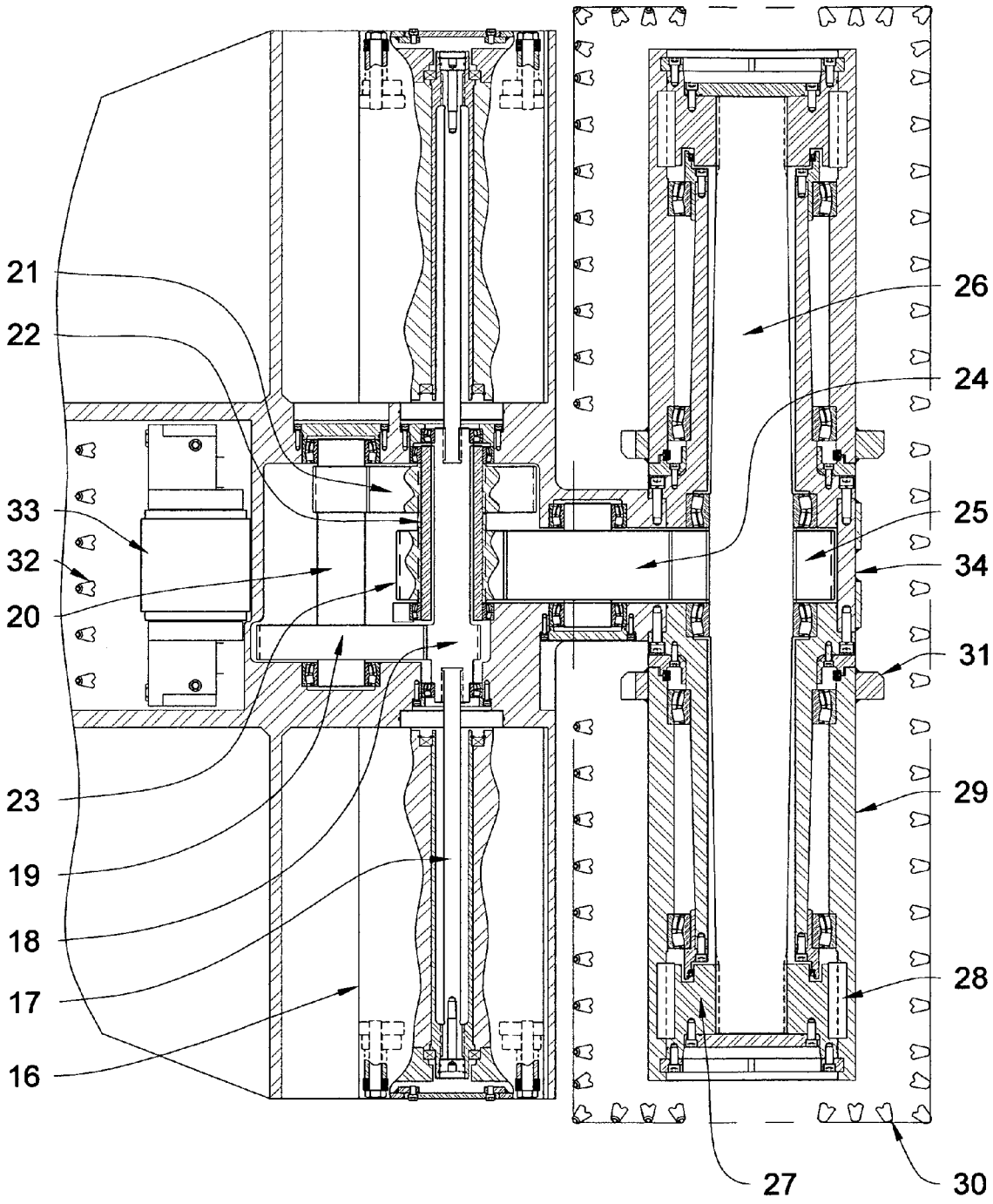

FIG. 13 Enlarged partial view of cutter boom assembly

Figure 14:
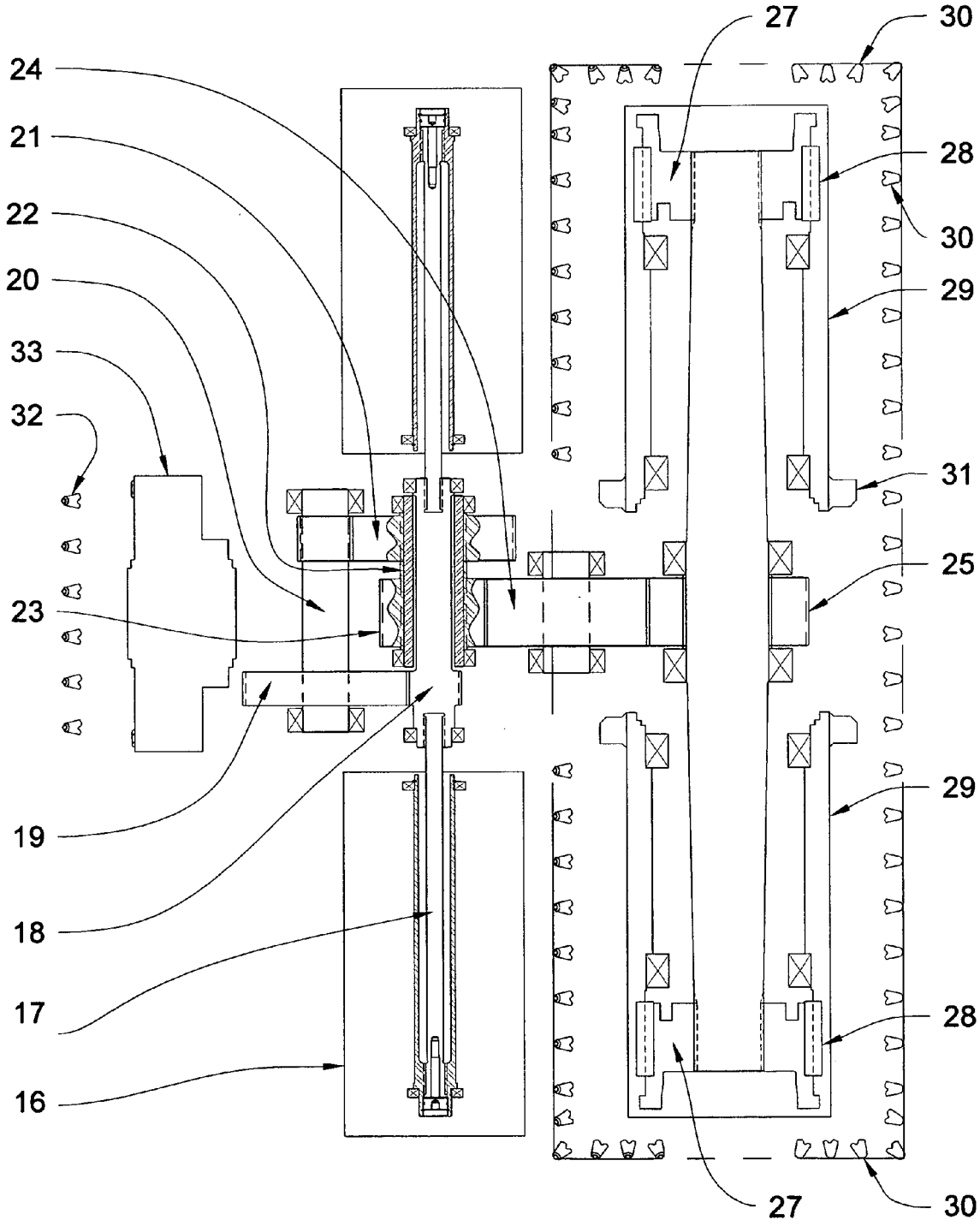

FIG. 14 Schematic view of cutter drive assembly

Figure 15A:
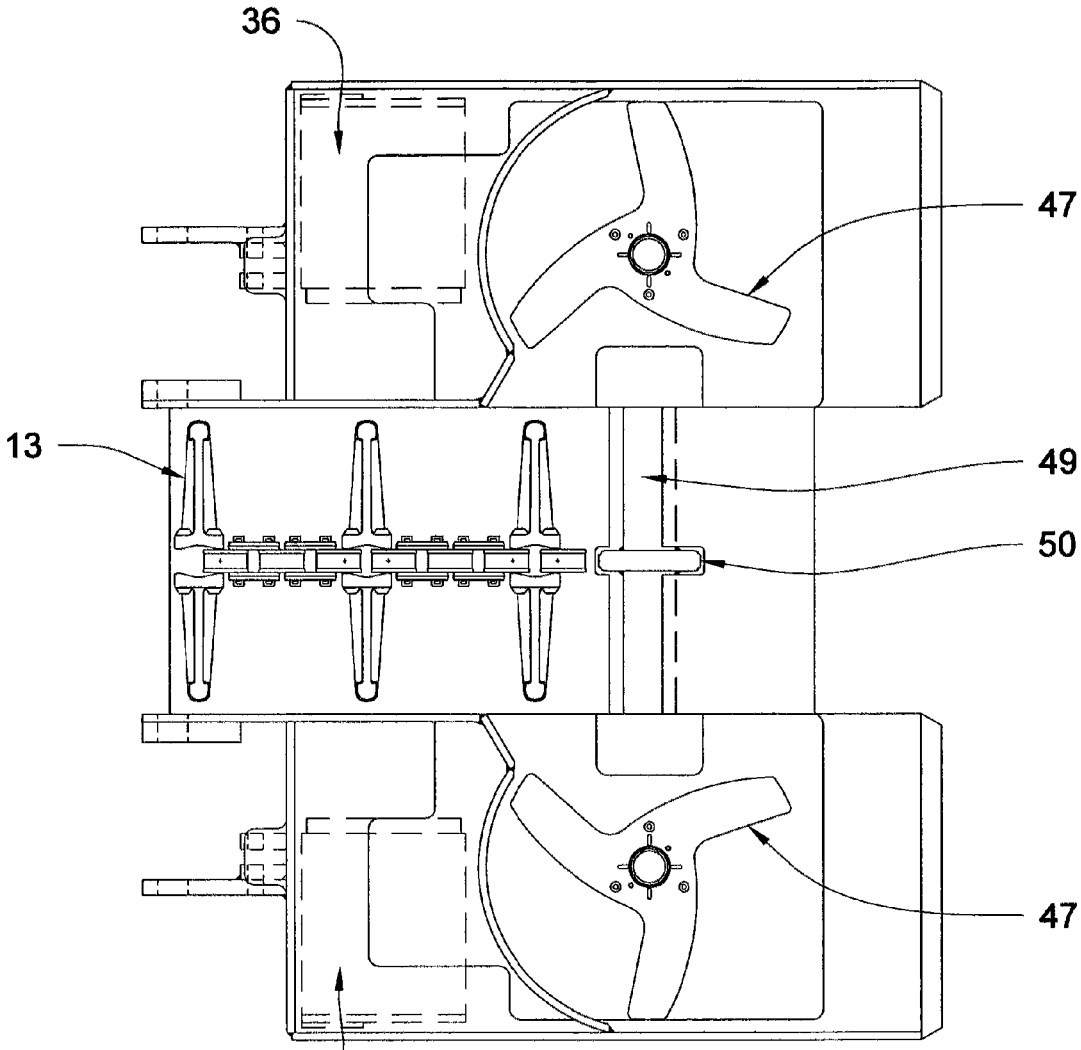

FIG. 15A Detail of gathering conveyor assembly

Figure 15B:
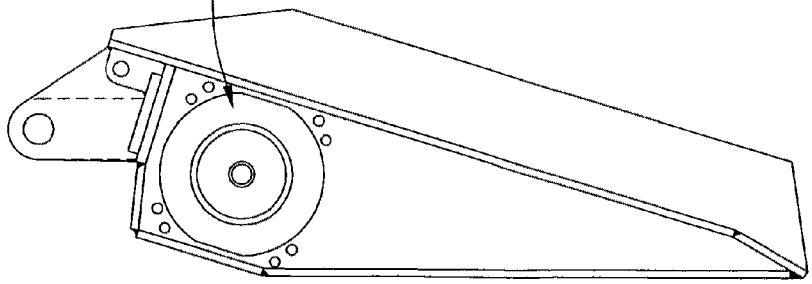

FIG. 15B Detail of gathering conveyor assembly

Figure 16:
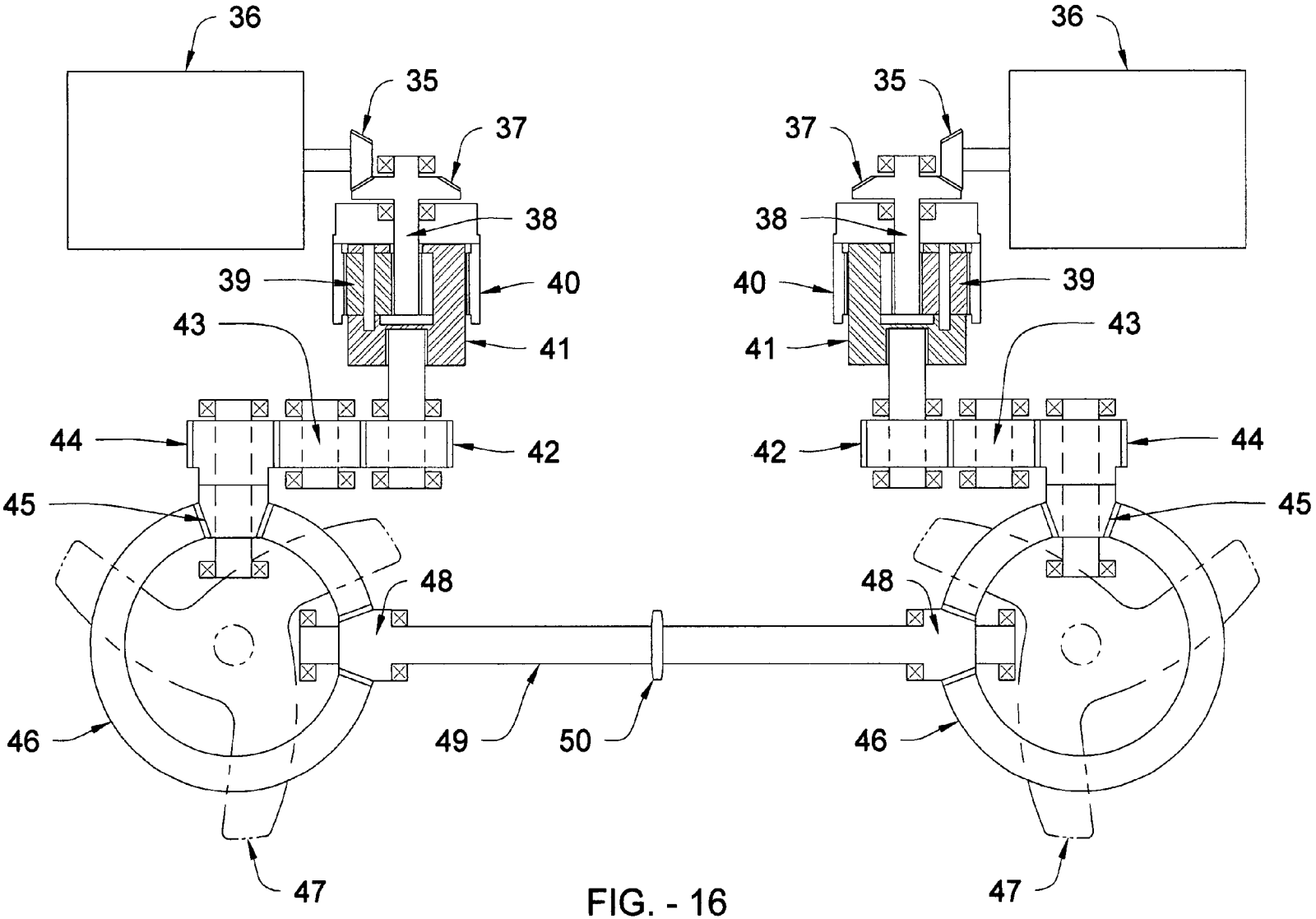

FIG. 16 Schematic view of gathering conveyor assembly

Figure 17A:
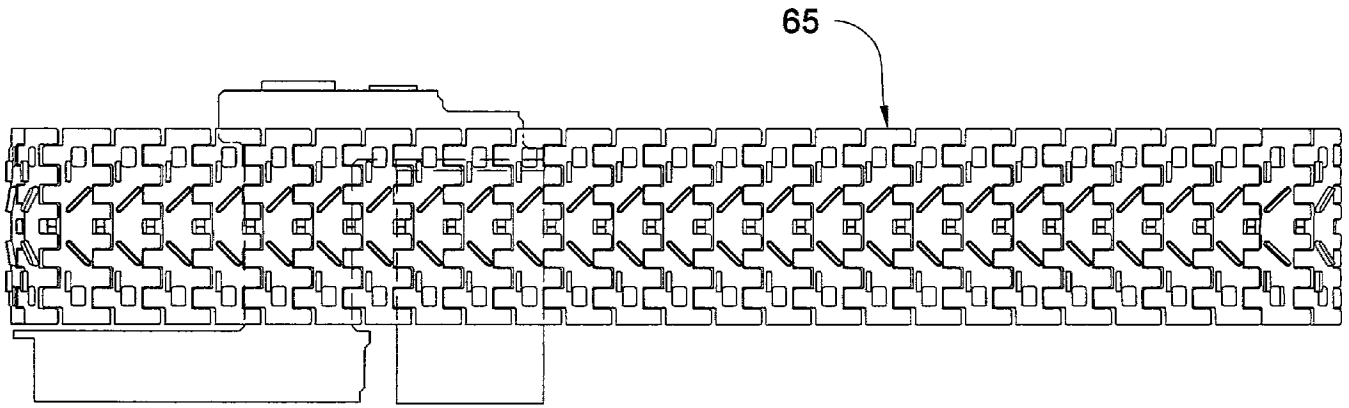

FIG. 17A Detail of crawler assembly—Top View

Figure 17B:
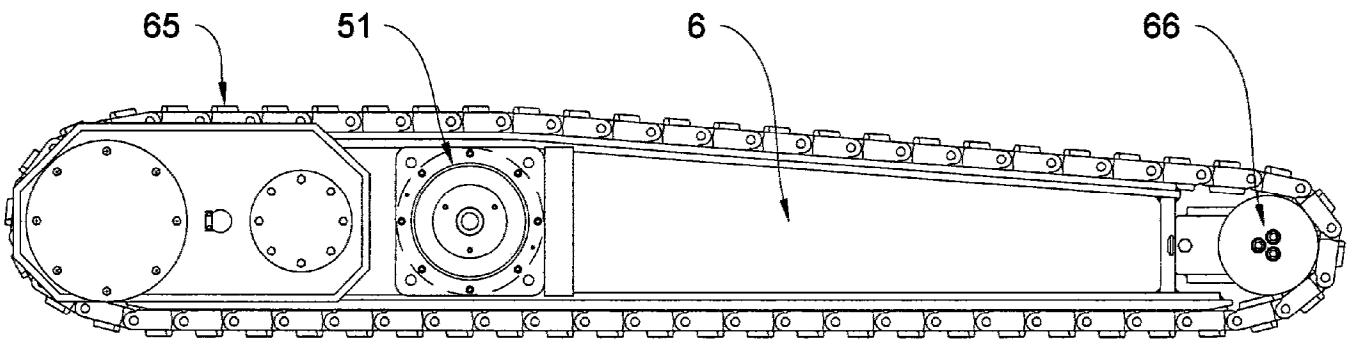

FIG. 17B Detail of crawler assembly—Side View

Figure 18:
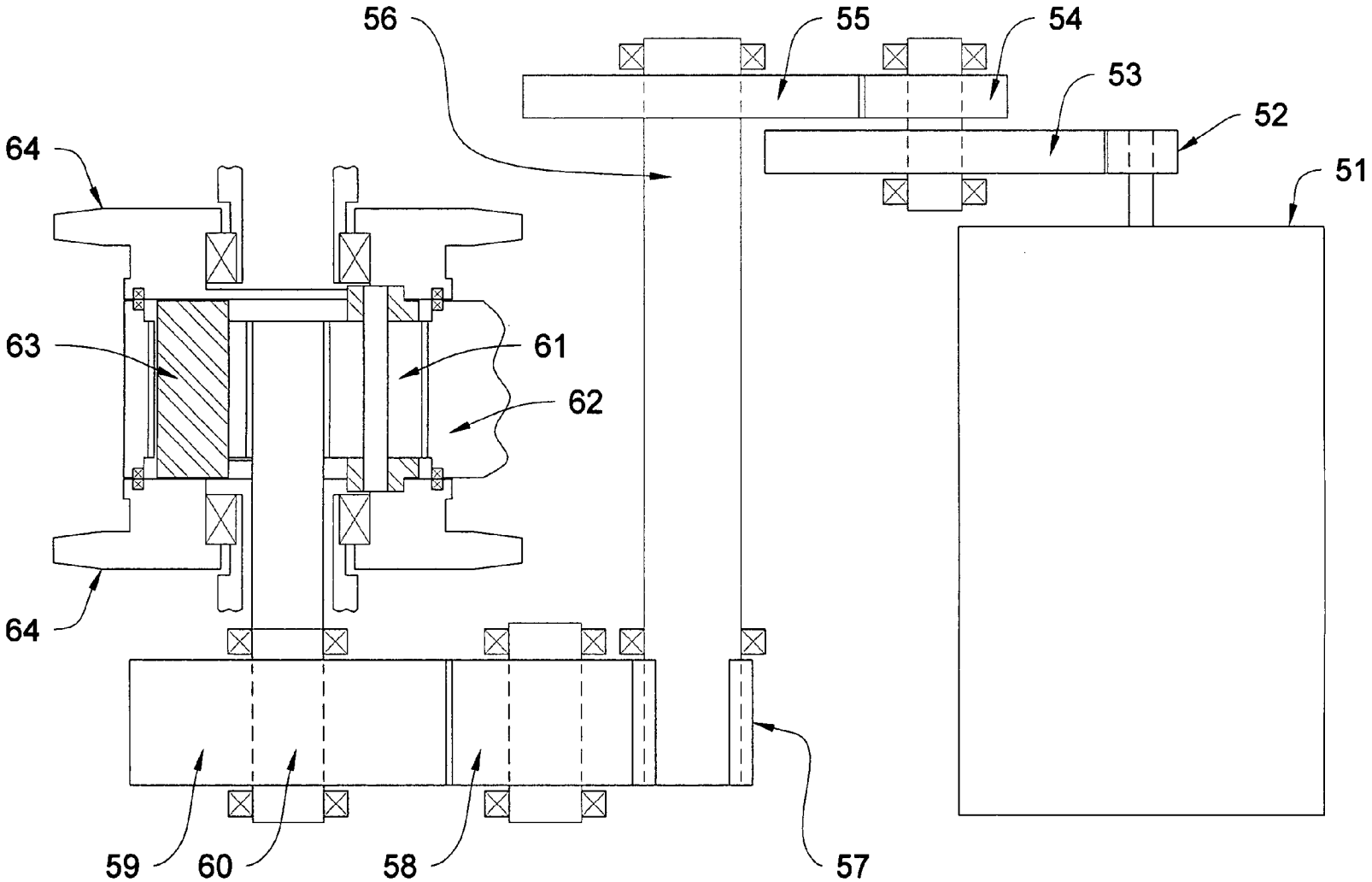

FIG. 18 Schematic view of crawler drive assembly

DETAILED DESCRIPTION OF DRAWINGS:

FIG. 1A, 1B, 2A & 2B General Arrangement of present invention

FIG. 1A—Top View

FIG. 1B—Side View

FIG. 2A—Top View

FIG. 2B—Side View

Cutter boom (1) and gathering conveyor (2) are connected to rear main frame (3) via yoke (4). Activation of swing cylinders (5) causes an articulation of front portion of the machine relative to rear portion of the machine. Propulsion of machine is facilitated by crawlers (6). Activation of boom swing cylinder (7) causes an articulation of discharge conveyor (8) to allow material to discharge at desired location.

Figure 1A:
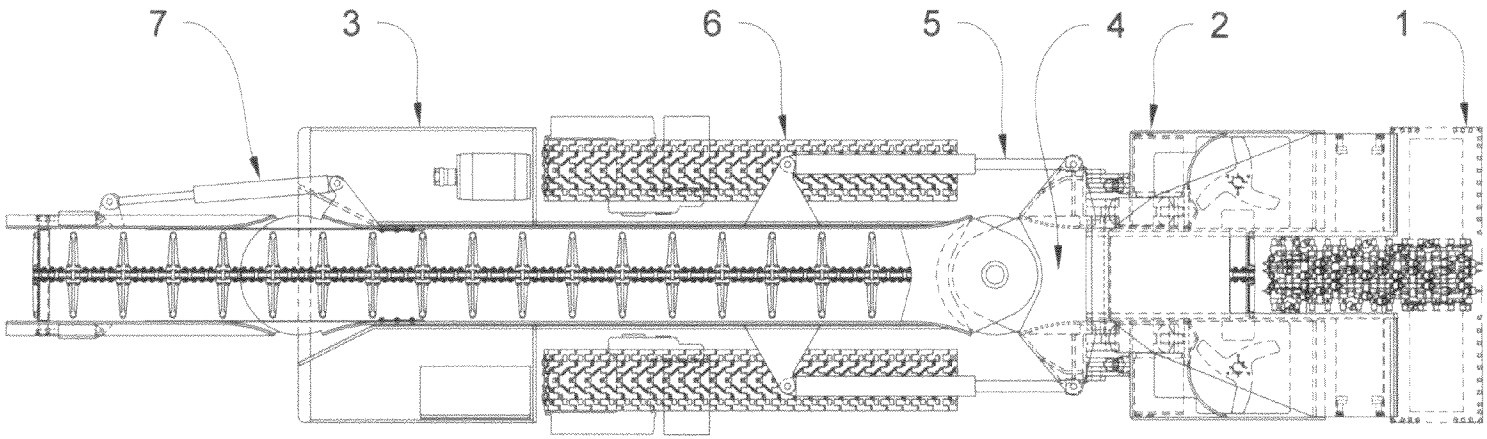
FIG. 1A General Arrangement of present invention—Top View
Figure 1B:
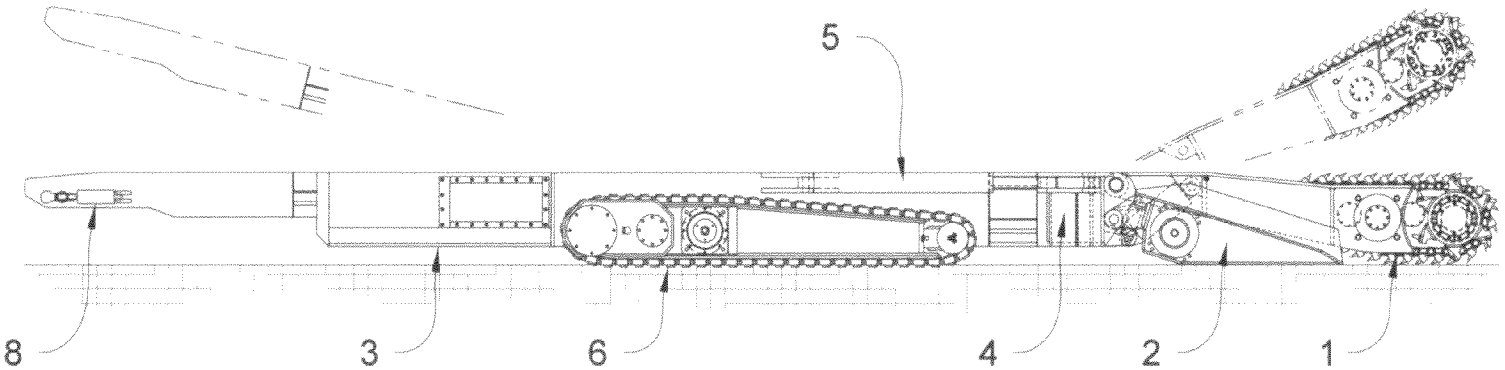
FIG. 1B General Arrangement of present invention—Side View
Figure 2A:
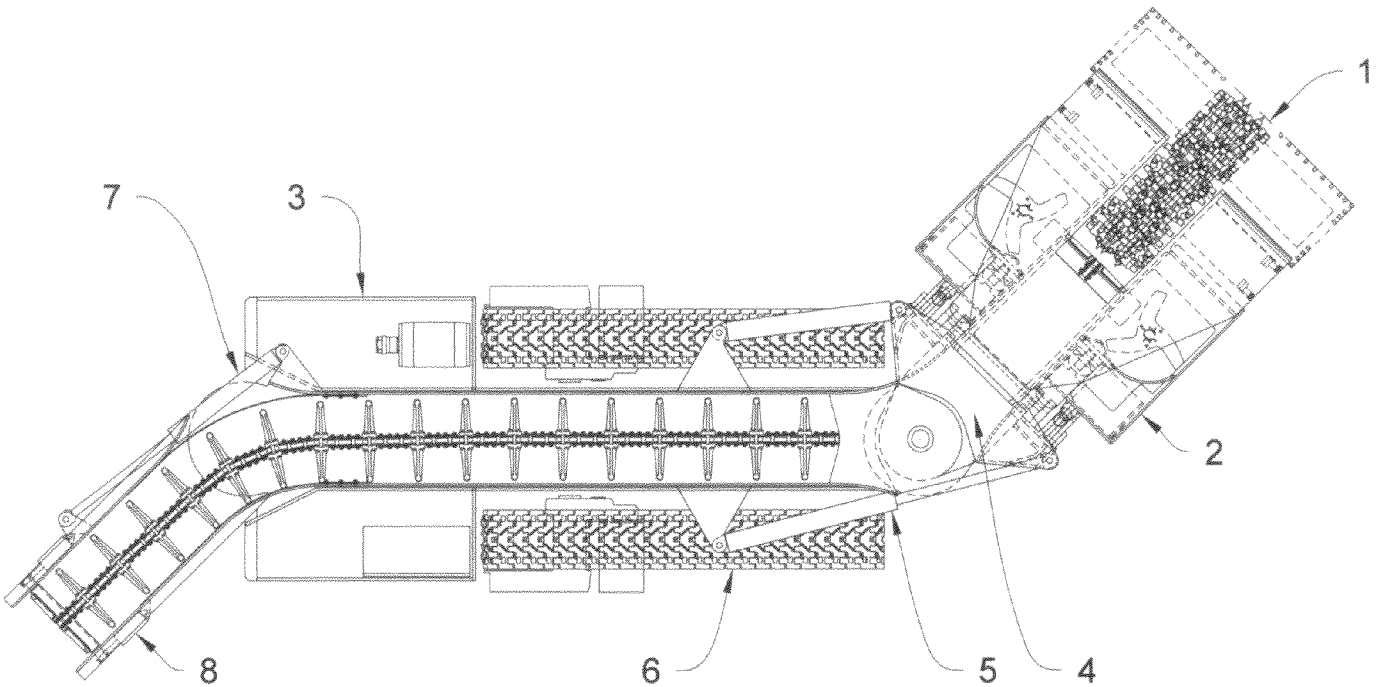
FIG. 2A General Arrangement of present invention—Top View
Figure 2B:
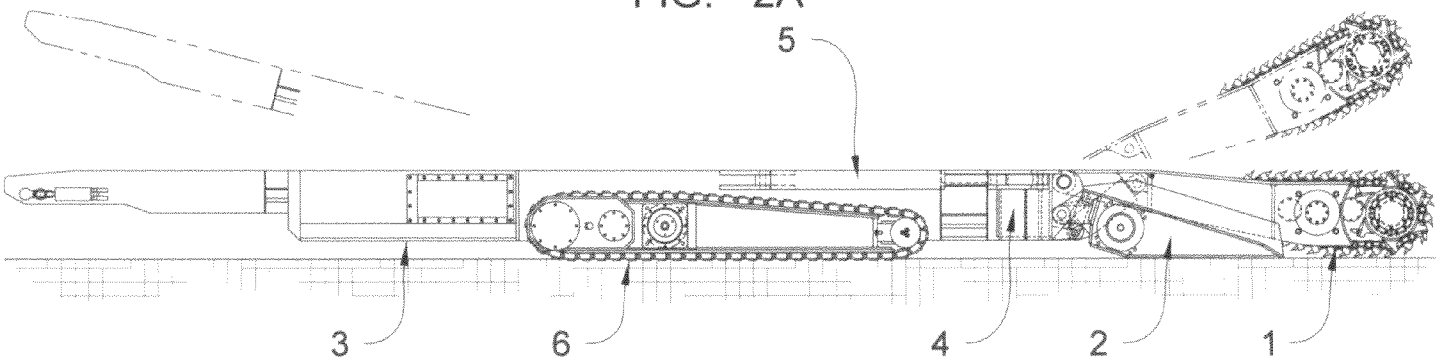
FIG. 2B General Arrangement of present invention—Side View
Figure 3:
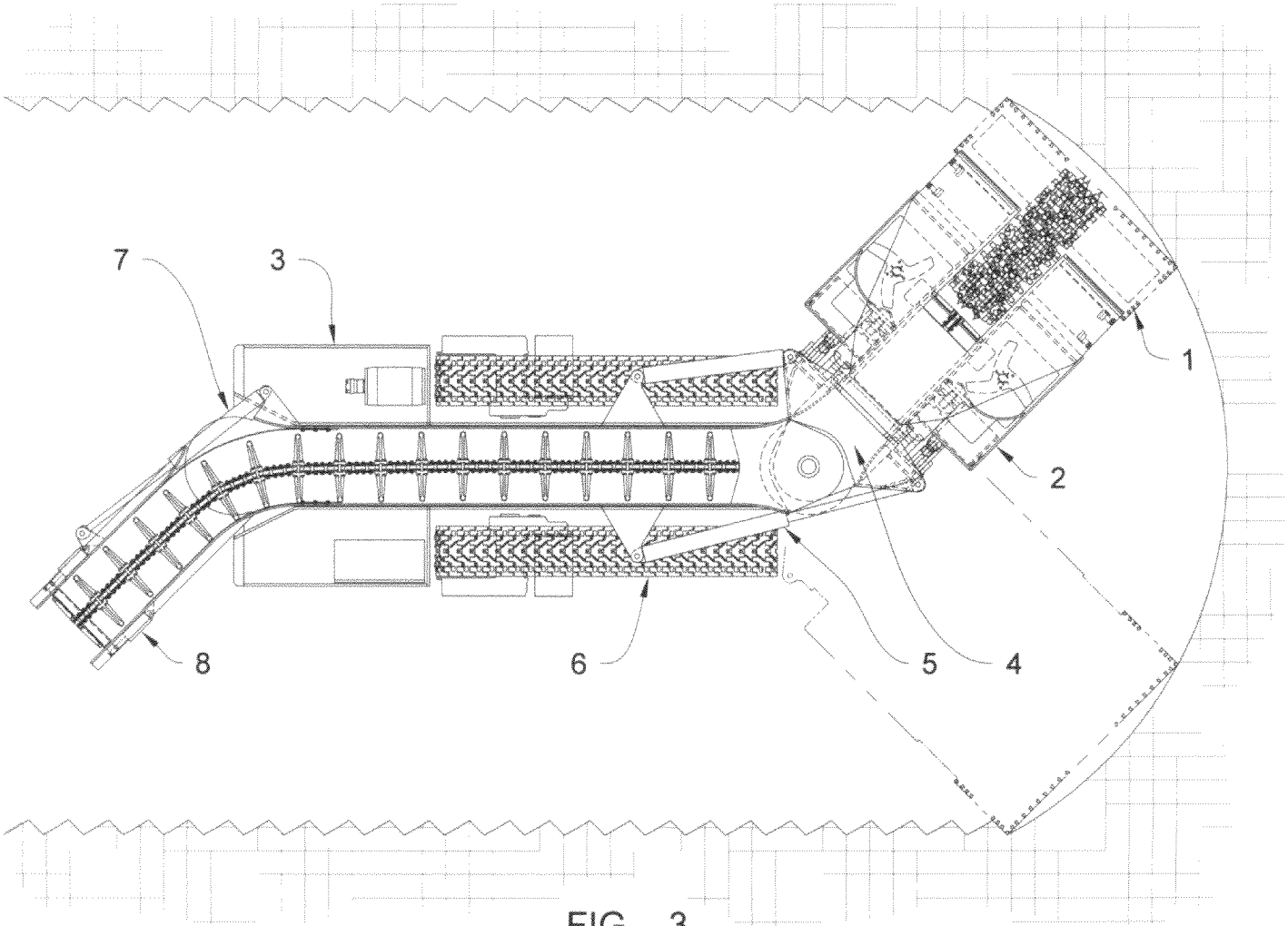
FIG. 3 General Arrangement of present invention

FIG. 3 General Arrangement of present invention

With cutter rotating and conveyor running the machine sumps forward a predetermined distance then stops. After sumping, the machine swings left or right a predetermined distance then stops. The machine then swings in the opposite direction a predetermined distance then stops. The machine then returns to original position then re-sumps for the next cycle of operation.

FIG. 4A & 4B General Arrangement of present invention (Alternate non-articulated version)

FIG. 4A—Top View

FIG. 4B—Side View

Cutter boom (1) and gathering conveyor (2) are connected to rear main frame (3). Propulsion of machine is facilitated by crawlers (6). Activation of boom swing cylinder (7) causes an articulation of discharge conveyor (8) to allow material to discharge at desired location.

FIG. 5A, 5B & 5C Articulation joint detail

FIG. 5A—Top View

FIG. 5B—Side View

FIG. 5C—End View

FIG. 6 Section view taken at cutting plane 6-6 (See FIG. 5A)

Yoke (4) and rear main frame (3) are connected via pins (9) and bearings (10). Thrust washers (11 & 12) are provided top and bottom—both connections.

FIG. 7 Detail view of cutter head, gathering conveyor, and yoke

FIG. 8 Section view taken at cutting plane 8-8 (See FIG. 7)

Conveyor chain (13) passes thru yoke (4) from gathering conveyor (2) to discharge conveyor (8) top (carrying) side and lower (return) side.

FIG. 9 Section view taken at cutting plane 9-9 (See FIG. 7)

Actuation of cutter lift cylinders (14) raises or lowers cutter boom (1)—pivoting at yoke (4).

FIG. 10 Section view taken at cutting plane 10-10 (See FIG. 7)

Actuation of gathering head lift cylinders (15) raises or lowers gathering head (2) pivoting at the yoke (4).

FIG. 11 Section view taken at cutting plane 11-11 (See FIG. 7)

FIG. 12 Detail of cutter boom assembly

FIG. 13 Enlarged partial view of cutter boom assembly

FIG. 14 Schematic view of cutter drive assembly

Electric motors (16) drive input gear/shaft—both ends (18) via torque shafts (17). Input gear (18) drives gear (19). Gear (19) is splined onto shaft/gear (20). Shaft/gear (20) drives gear (21). Gear (21) is splined onto shaft (22). Gear (23) is splined onto shaft (22). Shaft (22) and gear (23) drive idler gear (24). Idler gear (24) drives output gear (25). Output gear (25) is splined onto shaft (26). Ends of shaft (26) are splined onto hubs (27). Hubs (27) are rotatably fixed to drum (29) utilizing keys (28). The surface and ends of drum (29) are fitted with cutter bits (30) for mining material. The inboard ends of drum (29) are fitted with sprockets (31). Sprockets (31) engage with clearance cutting chain (32). Adjustable take-up roller (33) is provided to properly adjust tension of clearance cutting chain (32). Clearance cutting chain (32) is fitted with cutter bits (30) to cut clearance for gear housing (34).

FIG. 15 Detail of gathering conveyor assembly

FIG. 16 Schematic view of gathering conveyor assembly

Bevel pinion (35) is splined onto shaft of motor (36). Bevel pinion (35) drives bevel gear (37), Bevel gear (37) drives sun pinion (38). Sun pinion (38) drives planet gear (39). Planet gear (39) is engaged with stationary ring gear (40). Planet gear (39) rotates carrier (41) which is splined onto gear/shaft (42). Gear/shaft (42) drives idler gear (43). Idler gear (43) drives gear (44). Gear (44) and bevel gear (45) are fixed together. Bevel gear (45) drives bevel gear (46). Loading arms (47) rotate with bevel gear (46) to transfer mined material onto conveyor chain (13). Bevel gear (46) drives bevel gear (48). Bevel gear (48) is splined onto conveyor drive shaft (49). Conveyor drive shaft incorporates sprocket (50). Sprocket (50) engages with conveyor chain (13). Conveyor chain (13) propels mined material from receiving end of machine to discharge end of machine.

FIG. 17A & 17B Detail of crawler assembly—top and side view

FIG. 17A—Top View

FIG. 17A—Side View

FIG. 18 Schematic view of crawler drive assembly

Pinion (52) is splined onto output shaft of motor (51). Pinion (52) drives gear (53). Gear (53) is splined onto gear/shaft (54). Gear shaft (54) drives gear (55). Gear (55) drives transfer shaft (56). Transfer shaft (56) is splined onto gear (57). Gear (57) drives idler gear (58). Idler gear (58) drives gear (59). Gear (59) is splined onto sun pinion/shaft (60). Sun pinion/shaft (60)drives planet gear (61). Planet gear (61) is engaged with stationary ring gear (62). Planet gear (61) rotates planet carrier (63). Planet carrier (63) is engaged with output sprockets (64). Output sprockets (64) are engaged with crawler chain (65) to propel machine. Adjustable roller (66) is provided to adjust tension of crawler chain (65).

What is claimed:

1. A continuous mining machine comprising a main frame (3) supported on propulsion crawlers (6); a yoke assembly (4) pivotally attached to a front end of the main frame; a cutter boom (1) having cutting drums (29) attached at a first end of the cutter boom and the yoke assembly attached to a second end of the cutter boom; swing cylinders (5) attached to the main frame (3) and to the yoke assembly (4); cutter boom lift cylinders (14) attached to the yoke assembly (4) and the cutter boom (1);

a gathering conveyor (2) attached to the yoke assembly (4); gathering conveyor lift cylinders (15) attached to the yoke assembly (4) and the gathering conveyor (2); wherein the cutter boom (1) and gathering conveyor (2) can be raised or lowered independently via respective lift cylinders while simultaneously able to articulate left or right via connection to the yoke assembly and actuation of swing cylinders (15); a single first input gear/shaft (18) driven by two independent electric motors (16) at each of the respective ends of the first input gear/shaft (18), said first input gear/shaft (18), is coupled to a second gear (19), said second gear (19) is splined onto a third shaft/gear (20), said third shaft/gear (20) is coupled to a fourth gear (21), said fourth gear (21) is splined onto fifth shaft (22), said fifth shaft (22) is coupled to sixth gear (23), said sixth gear (23) is coupled to idler gear (24), said idler gear (24) is coupled to output gear (25), said output gear (25) is splined onto cutter drum shaft (26), ends of said cutter drum shaft (26) are splined onto hubs (27), said hubs (27) are rotatably fixed to cutting drums (29) utilizing keys (28).

* * * * *